US008272891B2

(12) United States Patent
Kataoka et al.

(10) Patent No.: US 8,272,891 B2
(45) Date of Patent: Sep. 25, 2012

(54) CONNECTOR

(75) Inventors: Yuta Kataoka, Hitachi (JP); Hideaki Takehara, Hitachi (JP); Kunihiro Fukuda, Tsukuba (JP); Sachio Suzuki, Hitachi (JP); Jun Umetsu, Hitachi (JP); Shinya Hayashi, Hitachi (JP)

(73) Assignee: Hitachi Cable, Ltd., Tokyo (JP)

( * ) Notice: Subject to any disclaimer, the term of this patent is extended or adjusted under 35 U.S.C. 154(b) by 0 days.

(21) Appl. No.: 13/137,250

(22) Filed: Aug. 1, 2011

(65) Prior Publication Data

US 2012/0052747 A1 Mar. 1, 2012

(30) Foreign Application Priority Data

Aug. 26, 2010 (JP) ..... 2010-189400

(51) Int. Cl.
*H01R 13/60* (2006.01)

(52) U.S. Cl. ..... 439/540.1

(58) Field of Classification Search ..... 439/372, 439/157, 346, 359, 296
See application file for complete search history.

(56) References Cited

U.S. PATENT DOCUMENTS

| | | | | |
|---|---|---|---|---|
| 6,719,590 | B1 * | 4/2004 | Wu | 439/638 |
| 6,969,284 | B2 * | 11/2005 | Singer et al. | 439/701 |
| 7,794,247 | B2 | 9/2010 | Suzuki | |
| 7,892,038 | B1 * | 2/2011 | Kataoka et al. | 439/660 |
| 7,922,518 | B1 * | 4/2011 | Takehara et al. | 439/485 |
| 7,955,110 | B1 * | 6/2011 | Kataoka et al. | 439/284 |
| 7,959,470 | B1 * | 6/2011 | Umetsu et al. | 439/626 |
| 7,980,879 | B2 * | 7/2011 | Suzuki et al. | 439/346 |
| 7,985,092 | B2 * | 7/2011 | Suzuki et al. | 439/346 |
| 8,100,708 | B2 * | 1/2012 | Kataoka et al. | 439/271 |
| 8,105,099 | B2 * | 1/2012 | Suzuki et al. | 439/157 |
| 8,123,546 | B2 * | 2/2012 | Suzuki et al. | 439/372 |
| 8,123,573 | B2 * | 2/2012 | Takehara et al. | 439/845 |
| 2005/0095921 | A1 * | 5/2005 | Nishide | 439/701 |
| 2009/0075506 | A1 | 3/2009 | Suzuki | |

FOREIGN PATENT DOCUMENTS

| | | |
|---|---|---|
| JP | 2004-056924 A | 2/2004 |
| JP | 4037199 B | 11/2007 |
| JP | 2009-070754 | 4/2009 |

* cited by examiner

*Primary Examiner* — Tulsidas C Patel
*Assistant Examiner* — Phuongchi Nguyen
(74) *Attorney, Agent, or Firm* — McGinn IP Law Group, PLLC

(57) ABSTRACT

A connector includes a first terminal housing for housing a first inner housing that houses a plurality of first connecting terminals vertically aligned at predetermined intervals, a second terminal housing for housing a second inner housing that houses a plurality of second connecting terminals vertically aligned at predetermined intervals, a plurality of insulating members that are aligned and housed in the first terminal housing and are fixed to the lower surfaces of the plurality of first connecting terminals, and a connecting member for collectively fixing and electrically connecting the plurality of first connecting terminals to the plurality of second connecting terminals at each contact point by pressing an upper surface of one of the second connecting terminals at an uppermost part of the laminated structure. The plurality of insulating members each have a same shape and size.

3 Claims, 4 Drawing Sheets

| |
|---|
| 1 CONNECTOR |
| 4a-4c FIRST CONNECTING TERMINAL |
| 5 FIRST TERMINAL HOUSING |
| 6a-6c SECOND CONNECTING TERMINAL |
| 7 SECOND TERMINAL HOUSING |
| 9 CONNECTING MEMBER |

1 CONNECTOR
4a-4c FIRST CONNECTING TERMINAL
5 FIRST TERMINAL HOUSING
6a-6c SECOND CONNECTING TERMINAL
7 SECOND TERMINAL HOUSING
8a-8c INSULATING MEMBER
9 CONNECTING MEMBER
55 BASE PORTION

CONNECTOR

The present application is based on Japanese Patent Application No. 2010-189400 filed on Aug. 26, 2010, the entire contents of which are incorporated herein by reference.

BACKGROUND OF THE INVENTION

1. Field of the Invention

The invention relates to a connector which is used for, e.g., an eco-friendly car such as a hybrid car and an electric car, in particular, to a connector which may be potentially employed for a connection of a power harness used for transmitting a large amount of power.

2. Description of the Related Art

A power harness is used for connecting between devices such as between a motor and an inverter or between an inverter and a battery in, e.g., a hybrid car or an electric car, which has made significant progress in recent years, for transmitting a large amount of power. The power harness is at one end thereof provided with a connector in a two-block structure composed of, e.g., a male connector portion provided with a male terminal as well as a first terminal housing for housing the male terminal and a female connector portion provided with a female terminal connected to the male terminal as well as a second terminal housing for housing the female terminal (see, e.g., JP-A 2009-070754).

In recent years, all components in such an eco-friendly car have been reduced in weight in order to improve the energy saving performance, and to reduce the size is one of effective means for reducing the weight.

For example, a technique therefor is disclosed in Japanese patent No. 4037199.

Japanese patent No. 4037199 discloses an electrical connection structure for vehicle in which connecting terminals of plural phases of conductive member led from a vehicle driving motor are connected to connecting terminals of plural phases of power line cable led from an inverter for driving the motor, a connecting terminal of each phase of the conductive member overlaps a corresponding connecting terminal of each phase of the power line cable, an insulating member is arranged on a surface opposite to an overlapping surface of the connecting terminals, and the overlapped terminals of each phase are tightened and fixed to the insulating member in an overlapping direction (or a lamination direction) by a single bolt provided at a position to penetrate therethrough.

In other words, Japanese patent No. 4037199 discloses a connection structure in which plural connecting terminals and insulating members compose a laminated structure and the connecting terminals are fixed and electrically connected all together at contact points by tightening a single bolt in an overlapping direction while plural contact points between the connecting terminals as an overlapping surface thereof are sandwiched, and this kind of configuration is more effective than the technique of JP-A 2009-070754 in that downsizing is easy.

Furthermore, Japanese patent No. 4037199 discloses a structure in which the insulation members sandwiching a contact point between the connecting terminals are supported by a separately provided retaining jig to allow gaps between the respective insulating members to be kept, and such a structure is effective in insertability of the connecting terminal.

SUMMARY OF THE INVENTION

However, the connection structure of Japanese patent No. 4037199 may include the following problems.

Since each of plural insulating members is separate from the connecting terminal, the insulating members may move when a fastening member, a bolt, is moved downward and pressed even though the insulating members can be supported by a retaining jig. In other words, since the insulating member and the connecting terminal move separately, a problem may arise that the positional relation between each insulating member and the contact point is less likely to be stable and the stabilizing support at a contact point cannot be ensured under the technique of sandwiching the contact point between the insulating members. In particular, when this technique is used for vehicles, a countermeasure against the influence of vibration on the contact point is needed, and the stabilizing support at the contact point is important from the above background.

In addition, since each of the plural insulating members is separate from the connecting terminal, there is a problem that the type and number of parts increase, and thus, assembly man-hours increases when such a connection structure is applied to a connector. Therefore, the inventors tried, if possible, to reduce the assembly man-hours so as to eventually lead to reduction in manufacturing cost.

Accordingly, it is an object of the invention to provide a technique that can offer the stabilizing support at the contact point for the connector with the structure to sandwich the contact point between the insulating members, and reduce the assembly man-hours by reducing the type and number of parts so as to eventually reduce the manufacturing cost.

(1) According to one embodiment of the invention, a connector comprises:

a first terminal housing for housing a first inner housing that houses a plurality of first connecting terminals vertically aligned at predetermined intervals;

a second terminal housing for housing a second inner housing that houses a plurality of second connecting terminals vertically aligned at predetermined intervals;

a laminated structure that the first connecting terminals and the second connecting terminals are alternately arranged so that upper surfaces of the plurality of first connecting terminals face lower surfaces of the plurality of second connecting terminals to form pairs when the first terminal housing is fitted to the second terminal housing;

a plurality of insulating members that are aligned and housed in the first terminal housing and are fixed to the lower surfaces of the plurality of first connecting terminals; and a connecting member for collectively fixing and electrically connecting the plurality of first connecting terminals to the plurality of second connecting terminals at each contact point by pressing an upper surface of one of the second connecting terminals at an uppermost part of the laminated structure, wherein the plurality of insulating members each have a same shape and size.

In the above embodiment (1) of the invention, the following modifications and changes can be made.

(i) A base portion for supporting the insulating member fixed to one of the first connecting terminals at a lowermost part of the laminated structure is formed on an inner surface of the first terminal housing so as to horizontally support the one of the first connecting terminals at the lowermost part of the laminated structure.

(ii) The connecting member is disposed on a side of the first terminal housing so as to have a gap for inserting the one of the second connecting terminals to be pressed between the one of the first connecting terminals at the uppermost part of the laminated structure and the connecting member, when the first terminal housing is not fitted to the second terminal housing.

Points of the invention

According to one embodiment of the invention, a connector is constructed such that an insulating member is integrated with a first connecting terminal. Therefore, the integration of the insulating member and the first connecting terminal can offer the stabilizing support at the contact point against the vibration of a vehicle. On the other hand, the insulating member and the first connecting terminal can be handled as one component. Thereby, it is possible to reduce the type and number of parts, and thus to reduce the assembly man-hours for assembling the connector. In addition, the connector is constructed such that the insulating members each have a same shape and size. As a result, it is possible to reduce the manufacturing cost of the connector.

BRIEF DESCRIPTION OF THE DRAWINGS

Next, the present invention will be explained in more detail in conjunction with appended drawings, wherein:

FIGS. 5A and 5B are views showing a first connecting terminal, wherein FIG. 5A is a side view and FIG. 5B is a top view;

FIGS. 7A and 7B are views showing a second connecting terminal, wherein FIG. 7A is a side view and FIG. 7B is a bottom view; and FIGS. 8A and 8B are views showing the second connecting terminal, wherein FIG. 8A is a side view and FIG. 8B is a top view.

DETAILED DESCRIPTION OF THE PREFERRED EMBODIMENTS

A preferred embodiment of the invention will be described below in conjunction with the appended drawings.

Figure 1:
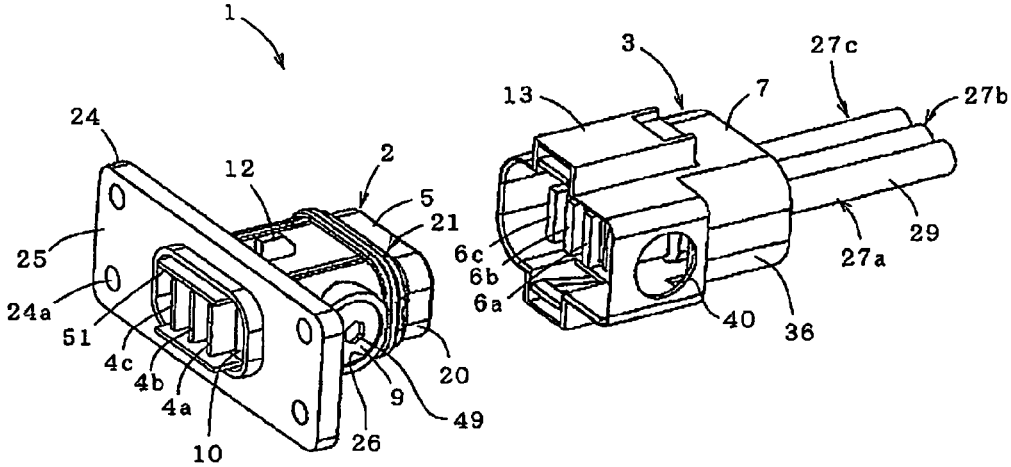
FIG. 1 is a perspective view showing first and second connector portions which compose a connector in an embodiment of the present invention.
Figure 2:
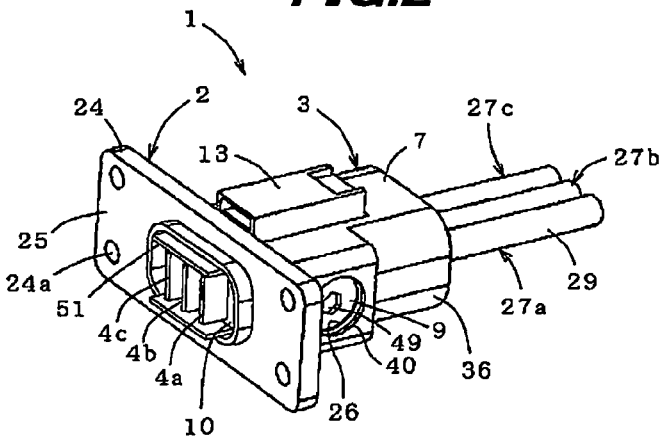
FIG. 2 is a perspective view showing the connector when the first connector portion is fitted to the second connector portion.
Figure 3:
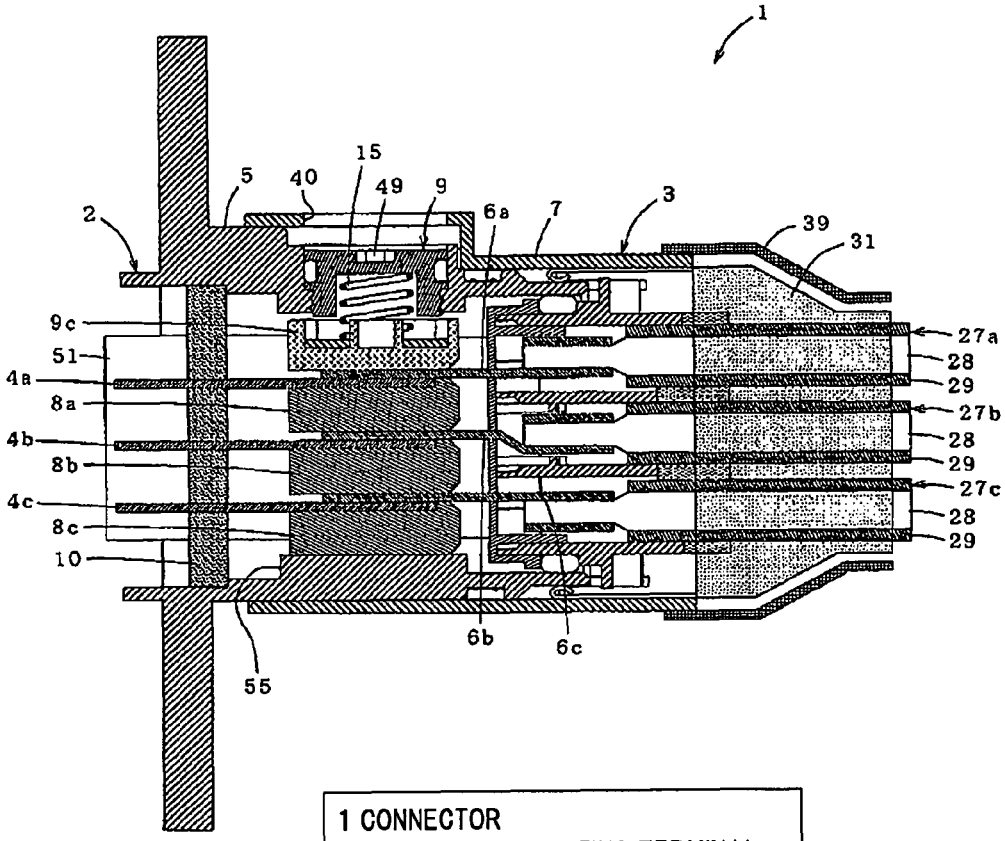
FIG. 3 is a cross sectional view showing the connector when the first connector portion is fitted to the second connector portion.

FIG. 1 is a perspective view showing first and second connector portions of a connector in a preferred embodiment of the invention, FIG. 2 is a perspective view showing the connector when the first connector portion is fitted to the second connector portion, and FIG. 3 is a cross sectional view thereof. Note that, a braided shield 31 and a rubber boot 39 which will be described later are omitted in FIGS. 1 and 2.

As shown in FIGS. 1 to 3, a connector 1 of the present embodiment is composed of a first connector portion 2 and a second connector portion 3, and plural power lines are connected at a time by fitting the connector portions 2 and 3 together.

More specifically, the connector 1 is provided with the first connector portion 2 having a first terminal housing 5 for housing a first inner housing 10 which holds plural (three) first connecting terminals (male terminals) 4*a* to 4*c* vertically aligned at predetermined intervals and the second connector portion 3 having a second terminal housing 7 for housing a second inner housing 52 which holds plural (three) second connecting terminals (female terminals) 6*a* to 6*c* vertically (vertical direction in FIG. 3) aligned at predetermined intervals. And the connector 1 has a laminated structure in which the first connecting terminals 4*a* to 4*c* and the second connecting terminals 6*a* to 6*c* are alternately arranged so that upper surfaces (on the upper side in FIG. 3) of the plural first connecting terminals 4*a* to 4*c* face lower surfaces (on the lower side in FIG. 3) of the plural second connecting terminals 6*a* to 6*c* to form respective pairs when the first connector portion 2 is fitted to the second connector portion 3.

The connector 1 is used for connecting, e.g., a motor for driving a vehicle to an inverter for driving the motor.

More specifically, the first terminal housing 5 of the first connector portion 2 (on the left side in FIG. 1) is fitted to a shield case of the motor, and portions of the first connecting terminals 4*a* to 4*c* exposed from the first terminal housing 5 are connected to respective terminals of a terminal block which is installed in the shield case of the motor. The second connector portion 3 electrically connected to the inverter is fitted to the first connector portion 2, thereby electrically connecting the motor to the inverter. The above is the connection on the motor side, and the connection on the inverter side is the same.

Each configuration of the connector portions 2 and 3 will be described in detail below.

Figure 4:
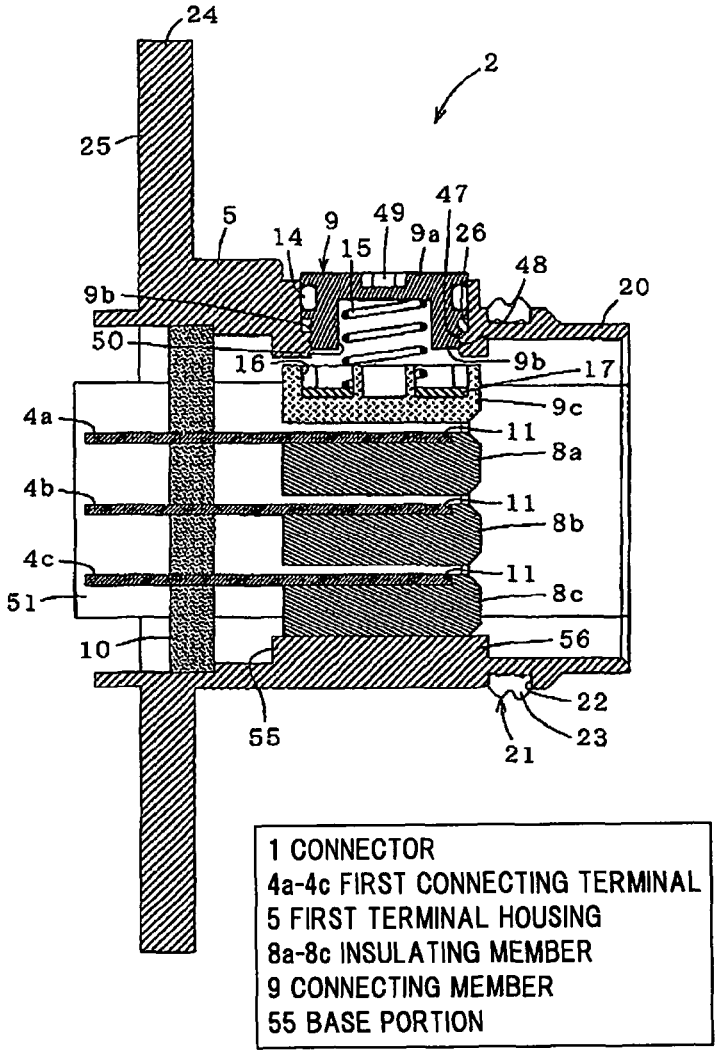
FIG. 4 is a cross sectional view showing the first connector portion.

As shown in FIG. 4, the first connector portion 2 holds, inside thereof, three first connecting terminals 4*a* to 4*c* aligned at predetermined intervals, and is provided with the first terminal housing 5 housing the three aligned first connecting terminals 4*a* to 4*c*, plural insulating members 8*a* to 8*c* in a substantially rectangular parallelepiped shape which are provided in the first terminal housing 5 for insulating the first connecting terminals 4*a* to 4*c* from each other, and a connecting member 9 for collectively fixing and electrically connecting the plural first connecting terminals 4*a* to 4*c* to the plural second connecting terminals 6*a* to 6*c* at respective contact points by pressing the upper surface of the uppermost second connecting terminal 6*a* of the laminated structure.

As a terminal housing, the first terminal housing 5 may be either male (a male terminal housing) or female (a female terminal housing). Here, the case where the first terminal housing 5 is a male terminal housing will be explained as an example.

The first connecting terminals 4*a* to 4*c* are plate-like terminals, are formed of non-conductive resin (e.g., PPS (polyphenylene sulfide) resin, PPA (polyphthalamide) resin, PA (polyamide) resin, PBT (polybutylene terephthalate) and epoxy-based resin), and are aligned and held at predetermined intervals in the first inner housing 10 which is housed in the first terminal housing 5 and is formed of a resin molded body. The method of holding the first connecting terminals 4*a* to 4*c* in the first inner housing 10 includes, e.g., a holding method in which the first connecting terminals 4*a* to 4*c* are inserted at the time of forming the first inner housing 10 and a resin is subsequently cured, and a holding method in which the first connecting terminals 4*a* to 4*c* are pressed into the preliminarily formed first inner housing 10, etc.

Electricity of different voltage and/or current is transmitted to each of the first connecting terminals 4*a* to 4*c*. For example, the present embodiment assumes the use of a three-phase AC power line between a motor and an inverter, and alternate current having a phase difference of 120° is transmitted to each of the first connecting terminals 4*a* to 4*c*. Each of the first connecting terminals 4*a* to 4*c* should be formed of a highly conductive metal such as silver, copper or aluminum to reduce transmission loss, etc., in the connector 1. In addition, each of the first connecting terminals 4*a* to 4*c* has little flexibility.

In addition, the first connecting terminals 4*a* to 4*c* are integrally fixed to the respective insulating members 8*a* to 8*c* which are adjacently arranged on the lower side (i.e., surfaces opposite to the surfaces connected to the second connecting terminals 6*a* to 6*c*). That is, as mentioned above, the first inner housing 10 holds the first connecting terminals 4*a* to 4*c* aligned at predetermined intervals and the insulating members 8*a* to 8*c* are integrally fixed at the end of the held first connecting terminals 4*a* to 4*c*, and as a result, the insulating members 8*a* to 8*c* are also aligned at predetermined intervals. Such a configuration ensures insulation between each contact point and insertability of the second connecting terminals 6*a* to 6*c* when fitted.

Figure 5A:
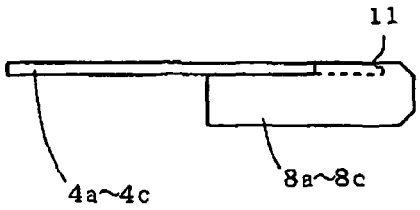
Figure 5B:
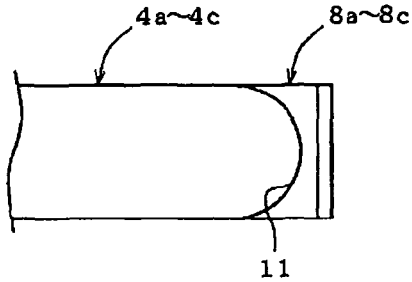

The plural insulating members 8*a* to 8*c* are aligned and housed in the first terminal housing 5 and are also fixed to the respective lower surfaces of the plural first connecting terminals 4*a* to 4*c* at positions to protrude on the front end side of the first connecting terminals 4*a* to 4*c*. A corner of each of the insulating members 8*a* to 8*c* on a side to insert and extract the second connecting terminals 6*a* to 6*c* is chamfered. In addition, a fitting groove 11 for fitting the first connecting terminals 4*a* to 4*c* to be fixed is each formed on the upper surfaces of the plural insulating members 8*a* to 8*c* as shown in FIGS. 5A and 5B. The first connecting terminals 4*a* to 4*c* to be fixed are fitted and integrally fixed to the fitting groove 11. As a result, a level difference between the insulating members 8*a* to 8*c* and the first connecting terminals 4*a* to 4*c* is filled, and the upper surfaces of the insulating members 8*a* to 8*c* are thereby flush with the upper surfaces of the first connecting terminals 4*a* to 4*c*. These configurations improve the insertion and extraction properties of the second connecting terminals 6*a* to 6*c* into and from the first connecting terminals 4*a* to 4*c* when the first connector portion 2 is fitted to the second connector portion 3.

In addition, each of the plural insulating members 8*a* to 8*c* is formed to have the same shape and size. The insulating members 8*a* to 8*c* formed in the same shape and size are respectively fixed to the first connecting terminals 4*a* to 4*c*, and thus, one component is composed of the insulating member 8*a* (or 8*b* or 8*c*) and the first connecting terminal 4*a* (or 4*b* or 4*c*).

Referring once again to FIG. 4, the connecting member 9 is a non-through type connecting member which has a main body composed of a large diameter portion 9*a* and a small diameter portion 9*b* integrally formed therewith, and a pressing portion 9*c* for pressing the upper surface of the uppermost second connecting terminal 6*a* of the laminated structure. The large diameter portion 9*a* and the small diameter portion 9*b* are formed of metal (e.g., SUS, iron and a copper alloy, etc.), and the pressing portion 9*c* is formed of non-conductive resin.

A packing 14 for preventing water from entering into the first terminal housing 5 is provided on the outer periphery of the large diameter portion 9*a*.

A male screw 48, which is joined together with a female screw 47 formed on an inner peripheral surface of a connecting member insertion hole 26 of the first terminal housing 5, is formed on an outer peripheral surface of the small diameter portion 9*b*. Such a configuration makes the connecting member 9 screwed together with the first terminal housing 5, thereby pressing the upper surface of the uppermost second connecting terminal 6*a* of the laminated structure.

An irregular shaped hole 49 (a hexagonal hole in FIG. 4A) is formed on the upper surface of the large diameter portion 9*a*, and the connecting member 9 can be rotated and tightened by fitting a tightening tool such as a spanner to the irregular shaped hole 49.

Meanwhile, the main body of the connecting member 9 is formed in a shape having two outer diameter dimensions, one of which is the large diameter portion 9*a* provided with the packing 14 and another of which is the small diameter portion 9*b* having the male screw 48 formed thereon, and the connecting member insertion hole 26 is formed in a shape which matches the shape having two outer diameter dimensions. An effective waterproof structure can be realized by such a configuration, i.e., by not arranging the female screw 47 at a portion facing the packing 14 when the connecting member 9 is tightened against the connecting member insertion hole 26.

In addition, the main body of the connecting member 9 has a hollow portion 50 which opens in the first terminal housing 5 and houses an elastic member 15 for imparting a predetermined pressing force to the pressing portion 9*c*. The elastic member 15 is composed of, e.g., a spring formed of metal (e.g., SUS, etc.). The elastic member 15 is regarded as a portion of the connecting member 9 in the present embodiment.

A concave portion 16 for covering (housing) a portion of the elastic member 15 is formed on the upper surface of the pressing portion 9*c* with which the elastic member 15 is partially in contact, and a receiving member 17 formed of metal (e.g., SUS, etc.) for preventing the pressing portion 9*c* formed of a non-conductive resin from being damaged by receiving the elastic member 15 is provided on a bottom of the concave portion 16 (i.e., a seat portion with which the elastic member 15 is partially in contact).

The receiving member 17 prevents damage of the pressing portion 9*c* by dispersing stress applied from the elastic member 15 to the upper surface of the pressing portion 9*c*. Therefore, a contact area between the receiving member 17 and the pressing portion 9*c* is preferably as large as possible. The receiving member 17 having a shape in contact throughout the entire surface of the bottom of the concave portion 16 is provided in the present embodiment in order to increase the contact surface between the receiving member 17 and the pressing portion 9*c*.

The main body of the connecting member 9 is inserted into the first terminal housing 5 and the main body and the pressing portion 9*c* are assembled as one unit, thereby assembling the connecting member 9 with the first terminal housing.

In addition, the connecting member 9 is provided on the first terminal housing 5 side so that a gap for inserting the second connecting terminal 6*a* to be pressed is formed between the uppermost first connecting terminal 4*a* of the laminated structure and the connecting member 9 when the first terminal housing 5 is not fitted to the second terminal housing 7. As a result, it is possible to ensure insertability of the second connecting terminal 6*a* which is inserted between the pressing portion 9*c* of the connecting member 9 and the first connecting terminal 4*a* underneath.

The connecting member 9 applies pressure in a screwing direction thereof (from the upper side to the lower side in FIG. 4) by joining the male screw 48 formed on the small diameter portion 9*b* together with the female screw 47 formed on the connecting member insertion hole 26, thereby collectively fixing and electrically connecting the plural first connecting terminals 4*a* to 4*c* to the plural second connecting terminals 6*a* to 6*c*.

The first terminal housing 5 is formed of a hollow cylindrical body 20 having a substantially rectangular shaped horizontal cross-section. An outer peripheral portion of one side (on the right side in the drawing) of the cylindrical body 20 which is fitted to the second terminal housing 7 is formed in a tapered shape in light of fitting properties to the second connector portion 3. Meanwhile, a rib 12 for stabilizing the fitting direction when fitted to the second terminal housing 7 as well as for fixation and stabilization after fitting is formed on the outer peripheral portion of the cylindrical body 20. In addition, a terminal housing waterproof structure 21 for sealing between the first connector portion 2 and the second connector portion 3 is provided on the outer peripheral portion of the one side of the cylindrical body 20. The terminal housing waterproof structure 21 is composed of a concave portion 22 formed on the outer peripheral portion of the cylindrical body 20 on the opening side and a packing 23 such as an O-ring provided on the concave portion 22.

The first inner housing 10 in which the first connecting terminals 4*a* to 4*c* are aligned and each held is housed in the cylindrical body 20 on the other side (on the left side in the drawing). A flange 24 for fixing the first connector portion 2 to a housing of a device, etc., (e.g., a shield case of a motor) is formed on an outer periphery of the other side of the cylindrical body 20. A packing, etc., for sealing between the housing of the device, etc., and the first connector portion 2 may be provided on a peripheral edge portion 25 of the flange 24 which is used for fixing to the housing of the device, etc., by inserting a bolt into a mounting hole 24*a*. The configuration of the flange 24 is not based on the premise that the first connector portion 2 is fixed to a housing of a device, etc., and the flange 24 may be alternatively provided on the second connector portion 3 or on both of the first connector portion 2 and the second connector portion 3. In addition, it may be in a free state that neither the first connector portion 2 nor the second connector portion 3 is fixed to a housing of a device, etc.

Meanwhile, the flange 24 is effective to improve heat dissipation. That is, a surface area of the first terminal housing 5 can be increased by forming the flange 24, and it is thus possible to improve the heat dissipation when heat generated inside the first connector portion 2 (e.g., heat generated at each contact point) is released to the outside through the first terminal housing 5.

The connecting member insertion hole 26 for inserting the main body of the connecting member 9 therethrough is formed on the upper portion (on the upper side in the drawing) of the cylindrical body 20. The connecting member insertion hole 26 is formed in a cylindrical shape and a diameter of a lower end portion thereof (on the lower side in the drawing) is reduced so as to match the shape of the main body of the connecting member 9. The reduced diameter portion contacts with the peripheral edge portion on the lower surface of the large diameter portion 9*a* of the connecting member 9, thereby restricting a stroke of the connecting member 9.

Meanwhile, a base portion 55 for supporting the insulating member 8*c* which is fixed to the lowermost first connecting terminal 4*c* of the laminated structure is formed on an inner peripheral surface of the cylindrical body 20 so as to horizontally support the lowermost first connecting terminal 4*c* of the laminated structure. The base portion 55 is formed by partially increasing the height of the inner peripheral surface of the cylindrical body 20 so as to have a size nearly equal to the insulating members 8*a* to 8*c* in order to realize stable pressure by the connecting member 9.

For shielding performance, heat dissipation and weight saving of the connector 1, the cylindrical body 20 is preferably formed of light metal having high electrical and thermal conductivity such as aluminum, but may be formed of resin. In the present embodiment, the cylindrical body 20 is formed of aluminum. By forming the cylindrical body 20 from aluminum as just described, there is an effect that the connecting member 9 can be tightened firmly to the connecting member insertion hole 26 when joined together as compared to the case where the cylindrical body 20 is formed of a non-conductive resin.

In the present embodiment, since a clearance between the laminated structure and the first terminal housing 5 is designed to be as small as possible in order to downsize the connector 1, it is necessary to ensure insulation between the first terminal housing 5 and the first connecting terminals 4*a* to 4*c* to prevent electrical short circuit of the first connecting terminals 4*a* to 4*c* via the metallic first terminal housing 5.

Therefore, in the present embodiment, an electricity shield 51 is provided on both sides of the first inner housing 10 in which the first connecting terminals 4*a* to 4*c* are aligned and held. The electricity shield 51 is integrally formed with the first inner housing 10.

Besides the effect of ensuring the insulation, the electricity shield 51 has a function of touch protection for preventing a foreign object such as a hand or a finger from touching the side surfaces of the first connecting terminals 4*a* to 4*c*. In other words, the electricity shield 51 provides the effect of ensuring the insulation between the first terminal housing 5 and the first connecting terminals 4*a* to 4*c* when the clearance between the laminated structure and the first terminal housing 5 is configured to be small in the extent that a hand or finger does not get in, and provides the effect of preventing the hand or finger from touching the side surfaces of the first connecting terminals 4*a* to 4*c* in a non-fitted state while still having some function of ensuring the insulation when the clearance is configured to be large such that a hand or a finger gets in.

Alternatively, the insulating members 8*a* to 8*c* may be formed so as to cover also the side surfaces of the first connecting terminals 4*a* to 4*c*, instead of providing the electricity shield 51.

Since it is considered that most of workers who manipulate the connector are adult men, a standard size of a hand or finger of a worker in the present embodiment is that of adult man. In this regard, however, this standard can be, of course, appropriately changed depending on the assumed worker.

Figure 6:
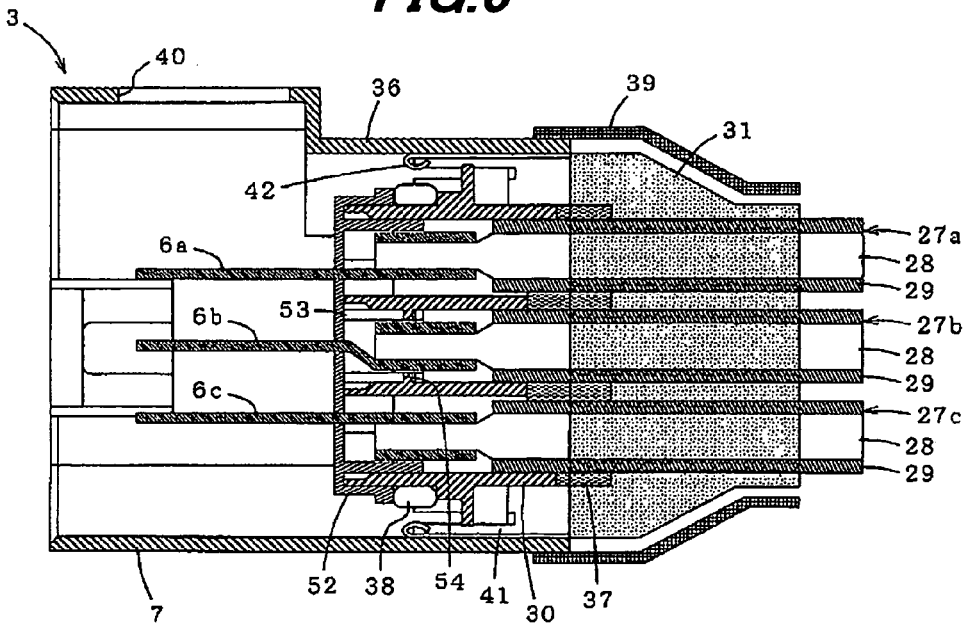
FIG. 6 is a cross sectional view showing the second connector portion.

As shown in FIG. 6, the second connector portion 3 has the second terminal housing 7 in which plural (three) aligned second connecting terminals (female terminals) 6*a* to 6*c* are housed. Here, a connector portion on a side having female terminals is referred to as the second connector portion 3. In other words, as a terminal housing, the second terminal housing 7 may be either male (a male terminal housing) or female (a female terminal housing). The case where the second terminal housing 7 is a female terminal housing which corresponds to the first terminal housing 5 as a male terminal housing will be explained here.

Figure 7A:
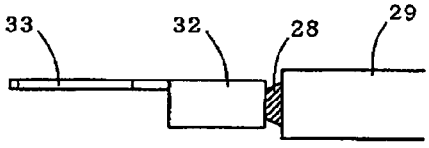
Figure 7B:
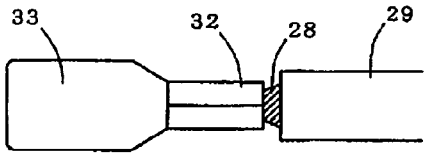
Figure 8A:
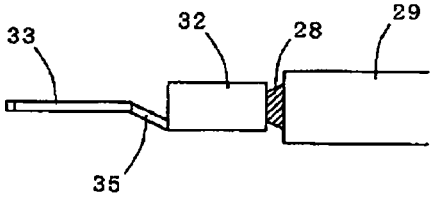
Figure 8B:
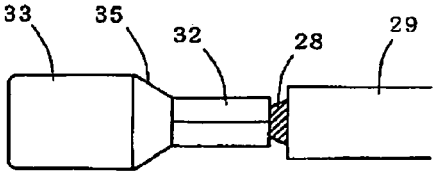

As shown in FIGS. 7 and 8, the second connecting terminals 6*a* to 6*c* each have a caulking portion 32 for caulking a conductor 28 which is exposed at an end portion of cables 27*a* to 27*c*, and a plate-like contact point 33 integrally formed with the caulking portion 32. The end portion of the plate-like contact point 33 may be formed in a tapered shape in order to improve insertability.

The present embodiment is configured such that the cables 27*a* to 27*c* are aligned and held with as little clearance as possible in order to downsize the connector 1. Therefore, a trunk portion 35 of the second connecting terminal 6*b* connected to the cable 27*b* which is arranged at the middle when aligned is bent as shown in FIG. 8 so that the second connecting terminals 6*a* to 6*c* are arranged at equal intervals.

Each of the second connecting terminals 6*a* to 6*c* should be formed of a highly conductive metal such as silver, copper or aluminum to reduce transmission loss, etc., in the connector 1. In addition, each of the second connecting terminals 6*a* to 6*c* has little flexibility.

The cables 27*a* to 27*c* extending from the inverter side are respectively connected to edges of the second connecting terminals 6*a* to 6*c*. The cables 27*a* to 27*c* are respectively electrically connected to the first connecting terminals 4*a* to 4*c* via the second connecting terminals 6*a* to 6*c*, and electricity of different voltage and/or current corresponding to each of the first connecting terminals 4*a* to 4*c* is transmitted. Each of the cables 27*a* to 27*c* is composed of the conductor 28 and an insulation layer 29 formed on the outer periphery thereof. The conductor 28 having a cross-sectional area of 20 $mm^2$ is used in the present embodiment.

The cables 27*a* to 27*c* are each held by a cable supporting member 30 which is in a multi-cylindrical shape (contiguous plural cylinders). The cable supporting member 30 is formed of a non-conductive resin, etc., to prevent short circuit by insulating the second connecting terminals 6*a* to 6*c* from each other. The cable supporting member 30 allows the second connecting terminals 6*a* to 6*c* to be held at respective predetermined positions even though each of the cables 27*a* to 27*c* respectively connected to the second connecting terminals 6*a* to 6*c* is very flexible. In other words, since a cable excellent in flexibility can be used as the cables 27*a* to 27*c* in the present embodiment, it is possible to improve the wiring flexibility for laying the cables 27*a* to 27*c*.

A second inner housing 52 formed of a resin molded body, in which the second connecting terminals 6*a* to 6*c* connected to the cables 27*a* to 27*c* are held so as to be aligned at predetermined intervals, is fitted to the end of the cable supporting member 30 in the fitting direction. By the second inner housing 52, the second connecting terminals 6*a* to 6*c* are positioned and held respectively on the first connecting terminals 4*a* to 4*c* (i.e., objects to be connected) respectively facing the second connecting terminals 6*a* to 6*c* so as to be respectively paired therewith when the first connector portion 2 is fitted to the second connector portion 3.

A holding method using insert molding, in the same manner as holding the first connecting terminals 4*a* to 4*c* in the first inner housing 10, can be employed as a method of holding the second connecting terminals 6*a* to 6*c* in the second inner housing 52.

However, unlike the case of first connecting terminals 4*a* to 4*c*, the second connecting terminals 6*a* to 6*c* are connected to the long cables 27*a* to 27*c* and if the method in which the second connecting terminals 6*a* to 6*c* are preliminarily held in the second inner housing 52 by the insert molding is employed, it is necessary to insert the second inner housing 52 from the rear end side of the cables 27*a* to 27*c* to fit to the cable supporting member 30, which is cumbersome.

Therefore, in the present embodiment, after the ends of the cables 27*a* to 27*c* are inserted into and held in the cable supporting member 30, the second inner housing 52 formed in a cap-like shape is fitted to the cable supporting member 30 so as to cover the second connecting terminals 6*a* to 6*c*, thereby aligning and holding the second connecting terminals 6*a* to 6*c*.

Meanwhile, a pawl portion 53 to be engaged with the cable supporting member 30 is formed on the second inner housing 52. The pawl portion 53 is engaged with an engaging portion 54 formed on the cable supporting member 30, and the second inner housing 52 is thereby fitted and subsequently fixed to the cable supporting member 30.

The second inner housing 52 is formed of a non-conductive resin, etc., and insulates the second connecting terminals 6*a* to 6*c* from each other to prevent short-circuit.

A braided shield 31 is wound around portions of the cables 27*a* to 27*c* which are pulled out from the second terminal housing 7, in order to improve the shielding performance. The braided shield 31 is in contact with the below-described cylindrical shield body 41, and is electrically connected to the first terminal housing 5 via the cylindrical shield body 41 (the same potential (GND)).

Referring once again to FIG. 6, the second terminal housing 7 is composed of a hollow cylindrical body 36 having a substantially rectangular horizontal cross section. Since the first terminal housing 5 is fitted in the second terminal housing 7, an inner peripheral portion of the cylindrical body 36 on one side (on the left side in the drawing) to be fitted to the first terminal housing 5 is formed in a tapered shape in light of fitting properties to the first terminal housing 5. Meanwhile, a fixing guide portion 13, by which the rib 12 formed on the cylindrical body 20 composing the first terminal housing 5 is received and guided to be fitted and fixed, is formed on the outer peripheral portion of the cylindrical body 36. The first terminal housing 5 is housed in and fitted to the second terminal housing 7 while the rib 12 is guided by the fixing guide portion 13, which allows smooth fitting, firm fixation after the fitting and prevention of looseness in fitting due to vibration.

Alternatively, the second terminal housing 7 may be configured to be fixed in the first terminal housing 5 in an opposite manner. In this case, the inner peripheral portion of one end of the cylindrical body 20 composing the first terminal housing 5 is formed in a tapered shape, the outer peripheral portion of one end of the cylindrical body 36 composing the second terminal housing 7 is formed in a tapered shape, and the terminal housing waterproof structure 21 is formed on the outer peripheral portion of the one end of the cylindrical body 36.

The cable supporting member 30 having cables 27*a* to 27*c* aligned and held therein is housed in the cylindrical body 36 on the other end side (on the right side in the drawing). A non-packing airtight portion 37 is formed on the cable supporting member 30 on a cable insertion side to prevent water from trickling down through the cables 27*a* to 27*c* and entering into the second terminal housing 7. A packing 38 in contact with an inner peripheral surface of the first terminal housing 5 is provided between the cable supporting member 30 and the second inner housing 52 on the outer peripheral portion of the cable supporting member 30. That is, the connector 1 has a double waterproof structure composed of the packing 23 of the terminal housing waterproof structure 21 and the packing 38 provided on the outer peripheral portion of the cable supporting member 30.

Furthermore, the outer periphery of the cylindrical body 36 on the other end side from where the cables 27*a* to 27*c* are led out is covered by a rubber boot 39 for preventing water from entering into the cylindrical body 36.

A connecting member manipulating hole 40, through which the connecting member 9 provided on the first connector portion 2 is manipulated when the second connector portion 3 is fitted to the first connector portion 2, is formed on an upper portion of the cylindrical body 36 (on the upper side in the drawing).

For shielding performance, heat dissipation and weight saving of the connector 1, the cylindrical body 36 is preferably formed of light metal having high electrical and thermal conductivity such as aluminum, but may be formed of resin, etc. Since the cylindrical body 36 is formed of a non-conductive resin in the present embodiment, the aluminum cylindrical shield body 41 is provided on an inner peripheral surface of the cylindrical body 36 on the other end side in order to improve the shielding performance and the heat dissipation.

The cylindrical shield body 41 has a contact portion 42 which comes in contact with an outer periphery of the aluminum first terminal housing 5 when the first connector portion 2 is fitted to the second connector portion 3, and the cylindrical shield body 41 and the first terminal housing 5 are thermally and electrically connected via the contact portion 42. This improves the shielding performance and the heat dissipation. Significant improvement is expected particularly in the heat dissipation by actively releasing heat to the first terminal housing 5 which is excellent in heat dissipation.

Connection between the first connecting terminals 4*a* to 4*c* and the second connecting terminals 6*a* to 6*c* using the connector 1 of the present embodiment will be described below.

When the first connector portion 2 is fitted to the second connector portion 3, the second connecting terminals 6*a* to 6*c* are respectively inserted into gaps between the respective pairs of the first connecting terminals 4*a* to 4*c* and the insulating members 8*a* to 8*c* and the pressing portion 9*c* of the connecting member 9. The insertion provides a laminated structure in which the first connecting terminals 4*a* to 4*c* and the second connecting terminals 6*a* to 6*c* are alternately arranged so that the upper surfaces of the plural first connecting terminals 4*a* to 4*c* face the lower surfaces of the plural second connecting terminals 6*a* to 6*c* to form the respective pair.

At this time, in the first connector portion 2, since the insulating members 8*a* to 8*c* are respectively fixed to the ends of the first connecting terminals 4*a* to 4*c* aligned and held at predetermined intervals, each gap between the insulating members 8*a* to 8*c* can be kept without additionally providing a retaining jig for keeping gaps between the respective insulating members 8*a* to 8*c*. In addition, since the connecting member 9 is provided so as to form a gap between the pressing portion 9*c* and the first connecting terminal 4*a*, it is also possible to keep the gap between the pressing portion 9*c* and the insulating member 8*a*. This makes easy to insert the second connecting terminals 6*a* to 6*c* into the gaps between the respective pairs of the first connecting terminals 4*a* to 4*c* and the insulating members 8*a* to 8*c* and the pressing portion 9*c*. In other words, the insertion and extraction properties of the second connecting terminals 6*a* to 6*c* are not degraded. In addition, it is very effective in that it is possible to realize further downsizing as compared to the conventional art since it is not necessary to provide a retaining jig for keeping the gaps between the insulating members 8*a* to 8*c*.

Meanwhile, a contact point between the first connecting terminal 4*a* and the second connecting terminal 6*a* is sandwiched between the insulating member 8*a* fixed to the first connecting terminal 4*a* composing a contact point and the pressing portion 9*c* of the connecting member 9. Likewise, a contact point between the first connecting terminal 4*b* (or 4*c*) and the second connecting terminal 6*b* (or 6*c*) is sandwiched between the insulating member 8*b* (or 8*c*) fixed to the first connecting terminal 4*b* (or 4*c*) composing a contact point and the insulating member 8*a* (or 8*b*) fixed to the first connecting terminal 4*a* (or 4*b*) composing another contact point.

After that, as shown in FIG. 3, when the male screw 48 of the connecting member 9 and the female screw 47 are joined together and tightened by manipulating the connecting member 9 through the connecting member manipulating hole 40, the connecting member 9 is turned and pushed into the first terminal housing 5, and then, the insulating member 8*a*, the insulating member 8*b* and the insulating member 8*c* are pressed in this order by the pressing portion 9*c* so that any two of the insulating members 8*a* to 8*c* and the pressing portion 9*c* sandwich each contact point and come in contact therewith in a state that the contact points are insulated from each other. At this time, the first connecting terminals 4*a* to 4*c* and the second connecting terminals 6*a* to 6*c* are bent in some degree due to pressure from the insulating members 8*a* to 8*c* and the pressing portion 9*c* and respectively make contact in a large area. This makes strong contact and fixation of each contact point eyen under the environment in which vibration occurs, such as in a vehicle. As a result, it is possible to realize a connector which is effective particularly for a vehicle in which vibration is likely to occur.

In sum, as described above, in the connector 1 of the present embodiment, since the plural insulating members 8*a* to 8*c* are integrally provided with the respective first connecting terminals 4*a* to 4*c*, the insulating member 8*a* (or 8*b* or 8*c*) and the first connecting terminal 4*a* (or 4*b* or 4*c*) can be handled as a component. Therefore, it is possible to reduce the type and number of parts, and thus to reduce the assembly man-hours. As a result, it is possible to reduce the manufacturing cost of the connector 1.

Although the invention has been described with respect to the specific embodiment for complete and clear disclosure, the appended claims are not to be therefore limited but are to be construed as embodying all modifications and alternative constructions that may occur to one skilled in the art which fairly fall within the basic teaching herein set forth.

The present embodiment assumes the use of a three-phase AC power line, however, according to the technical idea of the invention, it may be, e.g., a connector for a vehicle which is configured to collectively connect lines used for different purposes such as a three-phase AC power line between a motor and a vehicle and a two-phase DC power line for air conditioner. Since the configuration described above allows one connector to collectively connect power lines used for different purposes, it is not necessary to prepare different connectors for each intended purpose and it is thus possible to contribute to space saving and cost reduction.

In addition, although the first connecting terminals 4*a* to 4*c* are respectively in surface-to-surface contact with the second connecting terminals 6*a* to 6*c* in the present embodiment, it may be configured that a protruding portion is each formed on surfaces of the first connecting terminals 4*a* to 4*c* which are the contact side surface and are in contact with the second connecting terminals 6*a* to 6*c*, and the protruding portion is fitted to the plate-like contact point 33 of the second connecting terminals 6*a* to 6*c*. Each combining force between the first connecting terminals 4*a* to 4*c* and the second connecting terminals 6*a* to 6*c* can be more stabilized by the above-mentioned configuration. That is, it is particularly effective against vibration in a direction perpendicular to the connecting member 9.

Meanwhile, although the first connecting terminals 4*a* to 4*c* are linearly in contact with the second connecting terminals 6*a* to 6*c* when viewed from the large diameter portion 9*a* side of the connecting member 9 in the present embodiment, the first terminal housing 5 and the second terminal housing 7 may be configured so that the first connecting terminals 4*a* to 4*c* of the first connector portion 2 respectively in contact with the second connecting terminals 6*a* to 6*c* of the second connector portion 3 are crossed at a right angle when viewed from the large diameter portion 9*a* side of the connecting member 9. In other words, the first connector portion 2 and the second connector portion 3 may be fitted in an L-shaped manner. Likewise, it is possible to configure so that the second terminal housing 7 and the second connecting terminals 6*a* to 6*c* are arranged obliquely with respect to the first terminal housing 5 and the first connecting terminals 4*a* to 4*c*. By applying the aspect of the invention as described above, the insertion and extraction direction of the second connector portion 3 into and from the first connector portion 2 can be diversified. In other words, a direction of leading a cable from a connector can be adjusted to a desired direction, thereby contributing to space saving.

Alternatively, terminal surfaces of the respective first connecting terminals 4*a* to 4*c* and the second connecting terminals 6*a* to 6*c* may be each roughened by a knurling process to increase frictional force so as to make the terminals difficult to move, thereby strengthening the fixation at each contact point.

In addition, the case where a cable is not connected to one end of the first connecting terminals 4*a* to 4*c*, unlike the second connecting terminals 6*a* to 6*c*, has been described in the present embodiment, it is not limited to such a structure. That is, the connector of the present embodiment can be used for connecting between cables.

In addition, although a cable excellent in flexibility is used as the cables 27*a* to 27*c* in the present embodiment, a rigid cable may be used.

In addition, the connecting member 9 having the irregular shaped hole 49 has been explained as an example in the present embodiment, the configuration of the connecting member 9 is not intended to be limited to the form in which the irregular shaped hole 49 is formed, and, for example, a stem of a CPA (Connector Position Assurance) lever for securing the fitting of the first connector portion 2 to the second connector portion 3 may be configured as the connecting member 9 so that the fitting is secured by rotating the CPA lever and the connecting member 9 is pressed into (or tightened against) the first terminal housing 5.

In addition, although the connecting member 9 in which the irregular shaped hole 49 for fitting a hexagonal wrench (also called hexagonal spanner) is formed on the upper surface of the large diameter portion 9*a* is used in the present embodiment under an assumption of using a commercially available hexagonal wrench, it may be configured such that an irregular shaped hole 49 in a shape corresponding to that of a specialized tool is formed on the upper surface of the large diameter portion 9*a* under an assumption of using a specialized tool of which shape is not commercially available.

In addition, in the present embodiment, a direction of the connecting member 9 may be either horizontal or vertical when the connector is in use. In other words, a direction in a usage state is not a requirement in the use conditions of the connector of the present embodiment.

In addition, although the upper surface of the uppermost second connecting terminal 6*a* of the laminated structure is pressed by the pressing portion 9*c* via the elastic member 15 which is a portion of the connecting member 9 in the present embodiment, the pressing portion 9*c* may be integrally formed with the main body and press the upper surface of the uppermost second connecting terminal 6*a* of the laminated structure, without interposing the elastic member 15.

Note that, use of the connecting member 9 which is not the through type allows cost reduction as compared to the case of using the through type connecting member 9, and further, employing the non-through type connecting member 9 leads to weight saving of the connecting member 9, which can contribute to weight saving of the entire connector 1 as a result.

What is claimed is:

1. A connector, comprising:

a first terminal housing for housing a first inner housing that houses a plurality of first connecting terminals vertically aligned at predetermined intervals;

a second terminal housing for housing a second inner housing that houses a plurality of second connecting terminals vertically aligned at predetermined intervals;

a laminated structure that the first connecting terminals and the second connecting terminals are alternately arranged so that upper surfaces of the plurality of first connecting terminals face lower surfaces of the plurality of second connecting terminals to form pairs when the first terminal housing is fitted to the second terminal housing;

a plurality of insulating members that are aligned and housed in the first terminal housing and are fixed to the lower surfaces of the plurality of first connecting terminals; and a connecting member for collectively fixing and electrically connecting the plurality of first connecting terminals to the plurality of second connecting terminals at each contact point by pressing an upper surface of one of the second connecting terminals at an uppermost part of the laminated structure, wherein the plurality of insulating members each have a same shape and size.

2. The connector according to claim 1, wherein a base portion for supporting the insulating member fixed to one of the first connecting terminals at a lowermost part of the laminated structure is formed on an inner surface of the first terminal housing so as to horizontally support the one of the first connecting terminals at the lowermost part of the laminated structure.

3. The connector according to claim 1, wherein the connecting member is disposed on a side of the first terminal housing so as to have a gap for inserting the one of the second connecting terminals to be pressed between the one of the first connecting terminals at the uppermost part of the laminated structure and the connecting member, when the first terminal housing is not fitted to the second terminal housing.

* * * * *